US010856652B2

(12) United States Patent
Stanek et al.

(10) Patent No.: US 10,856,652 B2
(45) Date of Patent: Dec. 8, 2020

(54) TELESCOPIC COLUMN WITH INTERNAL CABLE

(71) Applicant: ROL Ergo AB, Jönköping (SE)

(72) Inventors: Carl Stanek, Jönköping (SE); Bruce Kamps, Jönköping (SE)

(73) Assignee: ROL ERGO AB, Jönköping (SE)

( * ) Notice: Subject to any disclaimer, the term of this patent is extended or adjusted under 35 U.S.C. 154(b) by 0 days.

(21) Appl. No.: 16/494,531

(22) PCT Filed: Mar. 16, 2018

(86) PCT No.: PCT/EP2018/056664
§ 371 (c)(1),
(2) Date: Sep. 16, 2019

(87) PCT Pub. No.: WO2018/172208
PCT Pub. Date: Sep. 27, 2018

(65) Prior Publication Data

US 2020/0085185 A1 Mar. 19, 2020

(30) Foreign Application Priority Data

Mar. 21, 2017 (EP) ..... 17162079

(51) Int. Cl.
*A47B 9/20* (2006.01)
*A47B 21/06* (2006.01)

(52) U.S. Cl.
CPC ..... *A47B 9/20* (2013.01); *A47B 21/06* (2013.01); *A47B 2200/0052* (2013.01)

(58) Field of Classification Search
CPC .... A47C 3/40; A47C 3/30; A47B 9/20; A47B 9/12; A47B 21/02; A47B 2200/0052; A47B 2200/0051
(Continued)

(56) References Cited

U.S. PATENT DOCUMENTS 3,415,586 A * 12/1968 Hammond ..... A47B 51/00 312/312
3,543,282 A * 11/1970 Lucien ..... A47B 27/14 108/147

(Continued)

FOREIGN PATENT DOCUMENTS

| | | | |
|---|---|---|---|
| DE | 29824529 | U1 | 6/2001 |
| EP | 2301382 | A1 | 3/2011 |
| WO | 2011063812 | A2 | 6/2011 |

OTHER PUBLICATIONS

International Search Report for International Application No. PCT/EP2018/056664, dated Apr. 6, 2018 (3 pages).
E-Space Translation for DE 29824529.

*Primary Examiner* — Jose V Chen
(74) *Attorney, Agent, or Firm* — Kagan Binder, PLLC

(57) ABSTRACT

The present application relates to a telescopic column (1) comprising a lower part (10) having a first end constituting a first end (4) of the telescopic column, an upper part (20) telescopically moveable relative to the lower part and having a first end constituting a second end (5) of the telescopic column opposite said first end of the telescopic column, a drive mechanism (2) configured to provide telescopic movement between the lower part and the upper part, an cable (30) extending inside the telescopic column, and a cable guiding means (50) coupled to a tensioning device (52) arranged at the second end of the telescopic column. The tensioning device is configured to control the position of the cable guiding means in the telescopic column based on the telescopic extension of the column, and the cable extends through the column via the cable guiding means. The present application further relates to an adjustable furniture (100) comprising at least one telescopic column.

12 Claims, 14 Drawing Sheets

(58) Field of Classification Search
USPC ..... 108/147, 147.19, 144.11; 248/188.2, 248/188.5
See application file for complete search history.

(56) References Cited

U.S. PATENT DOCUMENTS

| | | | | | |
|---|---|---|---|---|---|
| 3,887,155 | A * | 6/1975 | Bertalot | F16B 7/10 | 248/333 |
| 4,651,652 | A * | 3/1987 | Wyckoff | A47B 9/12 | 108/147 |
| 5,289,782 | A * | 3/1994 | Rizzi | A47B 9/02 | 108/146 |
| 5,400,721 | A * | 3/1995 | Greene | A47B 9/02 | 108/147 |
| 5,601,037 | A * | 2/1997 | Meyer | A47B 9/04 | 108/147 |
| 5,890,438 | A * | 4/1999 | Frankish | A47B 9/04 | 108/147 |
| 7,412,931 | B2 * | 8/2008 | Seidl | A47B 9/02 | 108/147 |
| 7,658,359 | B2 * | 2/2010 | Jones | A47B 9/00 | 248/406.1 |
| 7,810,793 | B1 | 10/2010 | Chiang et al. | | |
| 8,256,358 | B2 * | 9/2012 | Looser | A47B 27/02 | 108/147 |
| 9,038,549 | B1 * | 5/2015 | Zebarjad | A47B 9/02 | 108/147 |
| 2005/0279261 | A1 * | 12/2005 | Lo | A47B 9/083 | 108/147 |
| 2006/0042175 | A1 * | 3/2006 | Crespi | H02G 11/00 | 52/111 |
| 2009/0072101 | A1 * | 3/2009 | Stoelinga | F16H 19/06 | 248/188.5 |
| 2014/0103174 | A1 * | 4/2014 | Koder | A47B 9/12 | 248/188.5 |
| 2014/0360415 | A1 * | 12/2014 | Riis | F16B 7/14 | 108/147.19 |
| 2015/0136000 | A1 * | 5/2015 | Holtschi | A47B 9/20 | 108/146 |
| 2015/0320198 | A1 * | 11/2015 | Zebarjad | A47B 9/20 | 108/147 |
| 2016/0037907 | A1 * | 2/2016 | Ergun | A47B 9/02 | 108/147 |
| 2020/0093259 | A1 * | 3/2020 | Verhappen | A47B 21/02 | |

* cited by examiner

TELESCOPIC COLUMN WITH INTERNAL CABLE

CROSS-REFERENCE TO RELATED APPLICATIONS

This application claims priority to International Application No. PCT/EP2018/056664, filed Mar. 16, 2018 end titled "TELESCOPIC COLUMN WITH INTERNAL CABLE," which in turn claims priority from a European Patent Application having Ser. No. 17162079.2, filed Mar. 21, 2017, titled "TELESCOPIC COLUMN WITH INTERNAL CABLE," both of which are incorporated herein by reference their entireties.

TECHNICAL FIELD

The present disclosure relates to a telescopic column, and especially a telescopic column comprising telescopically arranged parts and means for guiding a cable extending through the column.

BACKGROUND

Adjustable furniture, such as tables, desks, chairs and beds, are known to use telescopic columns for height adjustment or other lifting operations. The telescopic column comprises a drive mechanism, for instance comprising a threaded spindle and a corresponding nut member, providing the telescopic movement, and a drive unit for operating the drive mechanism. The drive unit may comprise an electric motor requiring electric power. The power to the motor is provided by a cable connected to the mains. The furniture hence need to be placed adjacent a power socket for connection of the cable. At many locations, loose hanging cable should be avoided. Instead the cable may enter the furniture at a foot portion at floor level and further extending through the telescopic column to reach the electric motor.

At the foot portion, the cable need to be arranged in a fixed manner relative to the column at the exit point. Further, at the location of the electric motor the cable need to fix. In between, the arrangement of the cable need to allow extension and retraction of the column. Hence, there must be cable available when the column is extended from a retracted position. In the retracted position, the arrangement of cable leftover need to be considered.

When the cable extends inside the telescopic column, the cable may be damaged by the drive mechanism if not arranged suitably.

One solution is disclosed in document U.S. Pat. No. 7,647,659, in which a telescopic lifter comprises three tubes and has a pulley arranged to the middle tube on which the cable is suspended. However, such arrangement is rather complicated and provides several limitations to possible designs of the telescopic lifter.

Consequently, a safe arrangement of an electric cable inside a telescopic column is needed, which is reliable and still allows flexibility of the column design.

SUMMARY

It is an object of the present invention to provide an improved telescopic column. Furthermore, it is an object to provide a telescopic column being reliable and providing flexibility of the column design.

The invention is defined by the appended independent claims, with embodiments being set forth in the appended dependent claims, in the following description and in the drawings.

In a first aspect of the invention, a telescopic column is provided comprising a lower part having a first end constituting a first end of the telescopic column, an upper part telescopically moveable relative to the lower part and having a first end constituting a second end of the telescopic column opposite said first end of the telescopic column, a drive mechanism configured to provide telescopic movement between the lower part and the upper part, a cable extending inside the telescopic column, and a cable guiding means connected to a tensioning device arranged at the second end of the telescopic column. The tensioning device is configured to control the position of the guiding means in the telescopic column based on the telescopic extension of the column, and the cable extends through the column via the cable guiding means.

By means of such telescopic column, the cable that need to be provided to the second end of the column may be kept out of a user's sight. Further, tangled and unsightly cable may be eliminated, as well as trip hazards. The cable extending inside the column may further provide a clean look at the environment of the column, for instance around a furniture in which the column is provided.

The telescopic column may be used in adjustable furniture, such as a height-adjustable table, an adjustable bed or an adjustable chair. The lower part and the upper part may be tubes, for instance with a rectangular, square or circular cross-section. The lower part and the upper part may be telescopically moveable relative to each other, meaning that they may be arranged coaxially and having cross-sectional sizes that enables telescopic movement. The lower part may have a larger cross-sectional size to receive the upper part having a smaller cross-sectional size. Alternatively, the upper part may have a larger cross-sectional size than the lower part.

The telescopic column may further in one embodiment comprise a middle part, for instance a middle tube, also telescopically moveable relative to both the lower and the upper part. One advantage of the present invention is that the telescopic column is not limited to a certain shape of the lower and upper part, or to a certain number of telescopic parts. The telescopic column may provide the same technical advantages, and provide the same functionality, irrespective if it comprises two or three telescopic parts or tubes.

The cable guiding means may be connected or coupled to the tensioning device arranged at the second end of the column. At the second end of the column a housing may be provided to house the tensioning device. Such housing may be a drive housing also comprises a drive unit configured to drive the drive mechanism. Such second end may be an upper end in a standing telescopic column. At the second end the tensioning device may be arranged to be connected to the guiding means and to control the position and movement of the guiding means. The guiding means may thereby be connected to or suspended from the second end of the telescopic column. The control of the guiding means may be made based on the telescopic movement of the lower and upper parts, in order to control the cable's extension through the column. When the column is retracted or expanded, the position of the guiding means inside the upper part may be changed. One object of the invention may be that the cable's extension during expansion and retraction of the column is only modified inside the telescopic parts of the column. Hence, the cable may be fixed at its entering and exit points on the column. Since the cable extend via the guiding means, the guiding means' position may be controlled in order to control the cable's extension and enable an expansion of the column. This further provides that the cable may be kept in a stretched state throughout its extension through the column, both in expanded and retracted position of the column and during any movement there between. Any interference of the cable with the drive mechanism may thereby be avoided and unintentional damage to the cable may be prevented.

The cable guiding means may be a cable guide configured to guide the cable extending via said guide. The guiding may be provided such that a low friction movement of the cable via the guiding means may be provided.

The cable may inside the column be flexible enough to be guiding via the guiding means, i.e. to be turned 180 degrees in the limited space inside the column. A cable having a diameter of 5-6 mm comprising a flexible cover may for instance be used. Alternatively, a flat cable may be used, further providing less space needed for the cable's extension inside the column. The cable may be an electric cable to provide electric power to e.g. a drive unit. It may alternatively be a network cable (such as CAT6) or other communication cable, such as a HDMI cable, USB cable, fiber optic cable or the like.

The drive mechanism may be configured to be driven by a drive unit comprising an electric motor. Alternatively, the drive unit may comprise a crank to be used to drive the drive mechanism. Yet alternatively, the drive mechanism may be part of a spring arrangement in which a gas spring provides drive of the drive mechanism.

In one embodiment, the cable guiding means may comprise a pulley. A pulley may be used for guiding the cable inside the column. When the column is retracted or expanded, the pulley may be moved inside the upper part. The cable extending around the wheel of the pulley may then move relative to the pulley. The wheel of the pulley may thereby rotate to facilitate the movement of the cable.

In one embodiment, the guiding means may be configured to be moved up or down inside the upper part by means of the tensioning device when the telescopic column is retracted or expanded. The tensioning device may be configured to control the movement of the guiding means. The controlling may be made based on the retraction and expansion of the column. The connection between the controlling and the movement of the column may be mechanical, i.e. that the movement of the column mechanically affects the tensioning device's control of the guiding means position. Alternatively, the connection may be electrical, such that the movement of the column is detected and may electrically be provided as input to the tensioning device to control the position of the guiding means.

In another embodiment, the cable guiding means may be suspended in a wire to the tensioning device. The guiding means may be suspended in a wire from the tensioning device. The wire may be retracted or expanded by the tensioning device to move the guiding means up or down. An expansion of the column provides a movement of the guiding means away from the second end of the column, requiring an expansion of the wire. A retraction of the column provides a movement of the guiding means towards the second end of the column, requiring a retraction of the wire. The tensioning device may comprise a wire roll which may be rotated to expand or retract the wire.

In one embodiment, the tensioning device may be configured to provide a force on the guiding means directed towards the second end of the telescopic column. The tensioning device may comprise means for providing a force on the guiding means towards the second end of the column. The tensioning device may be a passive device providing said force continuously. The force may be predetermined to provide the desired movement of the guiding means towards the second end when the column is retracted. When the column is expanded, a force acting on the guiding means via the cable due to the expansion may exceed the force of the tensioning device, such that the guiding means may be moved away from the second end of the column. In one embodiment wherein the guiding means is suspended by a wire from the tensioning device, the tensioning device may be configured to provide a force by the wire roll to retract the wire, which force may be exceeded by an oppositely directed force via the cable when the column is expanded. Alternative solutions to provide a force on the guiding means may be possible, for instance by using a counterweight, by using electrical means, such as an electric motor, or by using an elastic means, such as an elastic band or string, in which the guiding means may be suspended.

In another embodiment, the tensioning device may comprise a spring. The spring in the tensioning device may be provided to control the movement of the guiding means. The guiding means may be connected to the spring, for instance via a wire or another mechanical link. The spring may provide a force acting on the guiding means and directed towards the tensioning device. The spring force level may be predetermined such that guiding means is pulled, by said force, towards the tensioning device when the column is retracted. The spring force level may further be predetermined such that the spring force acting on the guiding means is exceeded by an opposite force acting on the guiding means via the cable when the column is expanded. In an embodiment wherein the guiding means is suspended from the tensioning device by a wire, the spring may act on a wire roll providing the force on the guiding means via the wire. When the column is retracted, the spring may force the wire roll to roll up the wire using the spring force. When the column is expanded, the opposite force on the guiding means may provide the wire to be rolled out when said opposite force exceeds the spring force acting on the wire roll. In one embodiment, the spring may be a clock spring. A clock spring may provide a constant force during expansion and retraction, and may also have a high turning rate which enables a large amount of travel length for the wire and guiding means.

In a further embodiment, the cable may extend from said first end of the column to the guiding means and further to a second end of the upper part, said second end facing the lower part. The guiding means may be located inside the upper part. The upper part may have a first end which may be a second end of the column opposite the first end of the column. The cable may be configured to enter into the column at the first end of the column, and extend through the lower part in direction towards the second end of the column. A second end of the upper part may be the end opposite of the first end, said second end facing the lower part. When reaching the guiding means inside the upper part, the cable may extend further back towards the second end of the upper part, which may be in direction towards the first end of the column. By extending via the guiding means in such way, the cable may, when the guiding means is moved, always be kept in a stretched state. Any interference with the drive mechanism may thereby be avoided.

In one embodiment, the cable may be axially fixed at one end relative to the second end of the telescopic column and at another end relative to first end of the telescopic column.

The cable may enter the telescopic column at the first end of the column. The cable may further exit the column at the second end of the column. At these locations the cable may be fixed relative to column. Inside the column, the cable may be moveable relative to the parts of the column in order to enable retraction and expansion of the column in a safe manner.

In one embodiment, the telescopic column may further comprise a sheath through which the guiding means is moveable. The guiding means may be moveable in the upper part. In the upper part, a sheath may be arranged in which the guiding means is located. The sheath may extend along the upper part's extension. The sheath may be slightly shorter than the upper part. The guiding means may be moveably arranged inside the sheath. The sheath may be formed as a tube having open ends. The sheath may have a rectangular cross-section, but other shapes may as well be possible. The guiding means and the cable extending inside the sheath may be protected from being damaged or otherwise interfere with the drive mechanism. In an embodiment wherein the guiding means is suspended by a wire from the tensioning device, the wire may extend from the drive housing into the sheath through an end opening of the sheath and further to the guiding means. The sheath may be fastened at the second end of the column, for instance by being fastened to the upper part, or to a drive housing arranged at the second end of the column. The sheath may for instance be fastened by means of screws or snap fasteners.

In a further embodiment, the drive mechanism may comprise a spindle, and wherein the sheath may be separated from the spindle. The drive mechanism may comprise a rotatable spindle extending from a drive housing at the second end of the column, and through the upper part. The sheath may extend in parallel to the spindle, but separated therefrom. I.e. the sheath does not enclose the spindle. Instead, the sheath encloses the guiding means and may thereby protect the guiding means and the cable arranged on the guiding means from being damaged by the rotating spindle.

In a yet further embodiment, the sheath may comprise an insulated tube. The insulated sheath may be made from a plastic material or the like.

In another embodiment, the cable may extend from the first end of the telescopic column into the sheath to the guiding means, further through the sheath towards a second end of the upper part, which second end facing the lower part, and out of the sheath to further extend towards the second end of the telescopic column. The cable may be arranged to extend into the sheath to the guiding means, at which the cable may be arranged to make a U-turn and further extend back in direction towards the foot portion. At the end of the sheath being located adjacent the second end of the upper part, the cable may exit the sheath in its extension towards the second end of the column. From said exit point, the cable may extend outside the sheath further straight to the second end of the column. From the exit point to the second end of the column, the cable may always be fixed, i.e. that portion of the cable may not move when the column is retracted or expanded. In one embodiment, the cable may thereby be attached to the end of the sheath or to the second end of the upper part, and to the second end of the column, in order to be keep that portion of the cable in a stretched manner. The cable may also be fixed relative to the column and the upper part at the second end of the column. Damage to the cable by the spindle may thereby be prevented. Alternatively, an additional sheath or protective cover may be provided for said portion of the cable extending from the exit point to the second end of the column.

In one embodiment, the tensioning device may be arranged outside of either of the upper part and the lower part. The tensioning device may for instance be arranged inside a drive housing arranged at the second end of the upper part. By being arranged outside of the upper and lower part, the tensioning device may be more freely constructed in terms of size and function. Further, no complex parts of the tensioning device need to be fit into the upper or lower part, providing a risk of interfering with the cable, the cable guiding means or the drive mechanism. In a further embodiment, the tensioning device may be coupled to the cable guiding means via a wire. The wire may extend from the tensioning device being arranged outside of the upper part into the upper part to the cable guiding means. The tensioning device may provide the wire to be stretched, thereby taking as little space as possible within the upper or lower part, thereby reducing any risk of interfering with e.g. the driving mechanism. When the telescopic column is retracted to its most compact position, the tensioning device being arranged outside the upper and lower parts may further prevent the tensioning device from interfering with other components in the limited space within the upper and lower parts. In the embodiment wherein the tensioning device supports the cable guiding means via a wire, the wire may be close to completely wound up in the tensioning device when the column is in the most retracted position. The wire thereby will not take up any unnecessary space within the upper or lower part.

According to a second aspect of the invention, an adjustable furniture is provided, comprising a telescopic column according to the above. The furniture may further comprise a power unit and/or control unit configured to control the drive mechanism in the telescopic column. The furniture may further comprise a plurality of telescopic columns.

BRIEF DESCRIPTION OF THE DRAWINGS

The invention will in the following be described in more detail with reference to the enclosed drawings, wherein.

DESCRIPTION OF EMBODIMENTS

Figure 1A:
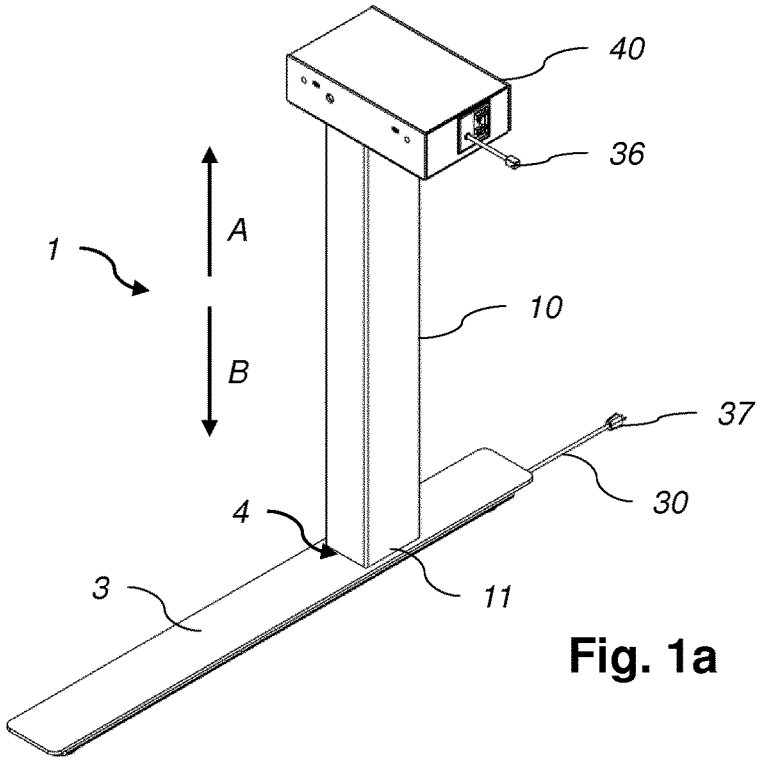
FIGS. 1*a*, 1*b* and 1*c* are perspective views of a telescopic column according to embodiments of the invention.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

Figure 1B:
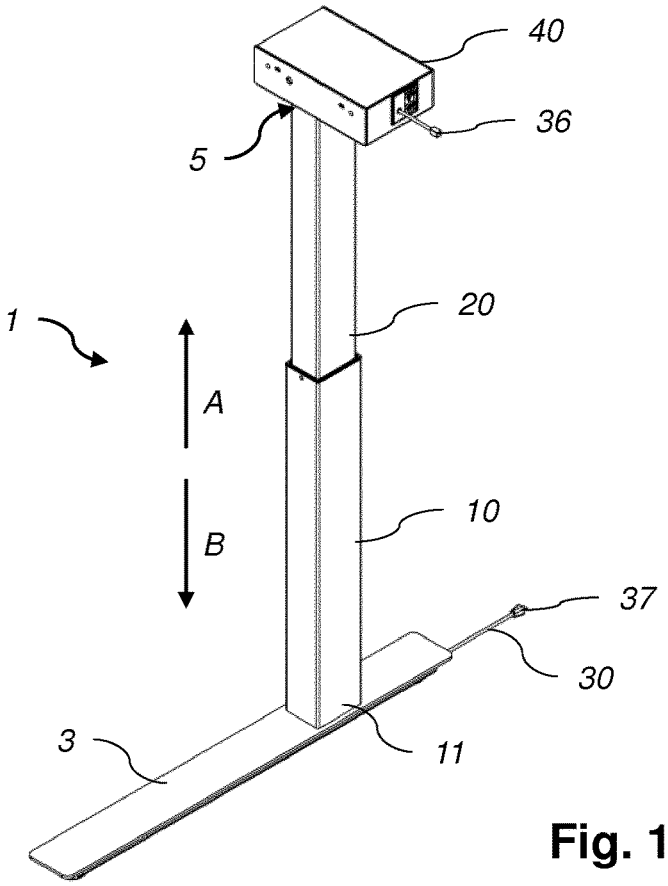

FIGS. 1*a* and 1*b* illustrate a telescopic column 1 according to an embodiment of the invention. The column 1 comprises a lower tube 10 and an upper tube 20 telescopically moveable relative to each other. At a first end 4 of the column 1 is a foot 3 arranged. At a second end 5 of the column 1 there is a drive housing 40. Through the column 1, a cable 30 extends. The cable 30 has a first end 37 entering the column 1 at the first end 4. At the first end 4 the cable 30 is fixed relative to the lower tube 10. The cable 30 exits the column 1 at the second end 5 through the drive housing 40 to a second end 36. The second end 36 of the cable is fixed relative to the second end 5 as it exits the column 1.

Figure 1C:
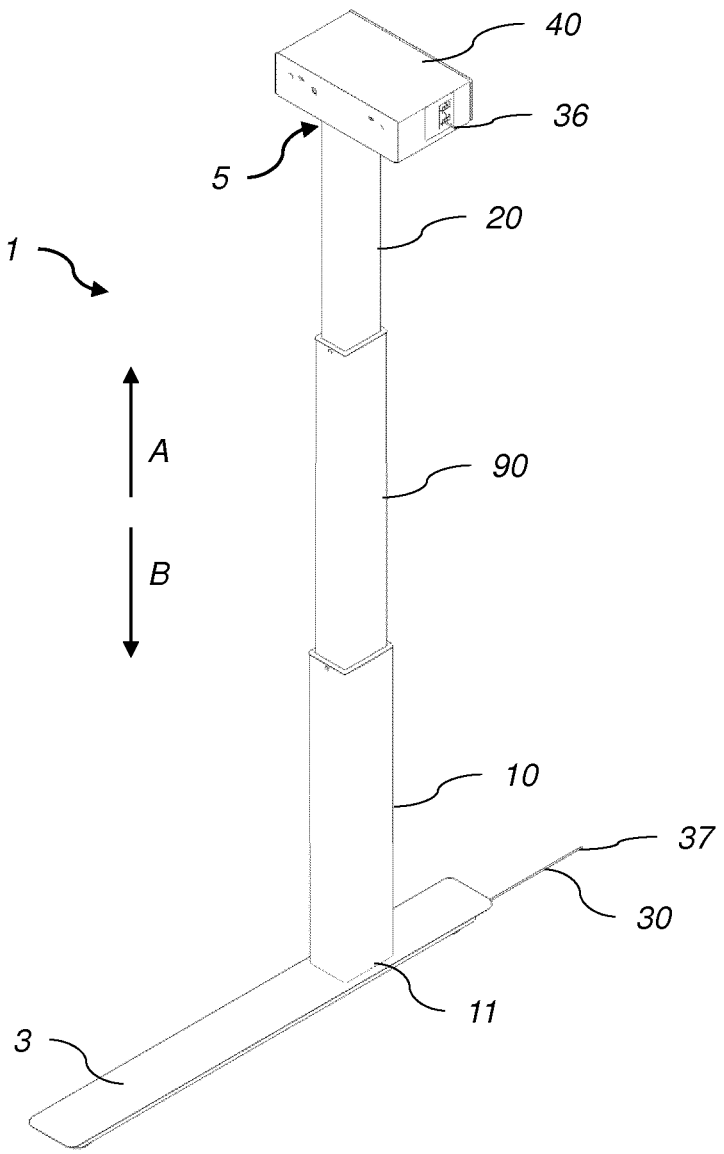

FIG. 1*c* further illustrate an embodiment of the telescopic column 1 comprising three tubes. Between the lower tube 10 and the upper tube 20 is a middle tube 90 arranged. The cable 30 extends through all three tubes 10, 90, 20 on its way from the first end 4 towards the second end 5 of the column 1.

Figure 2A:
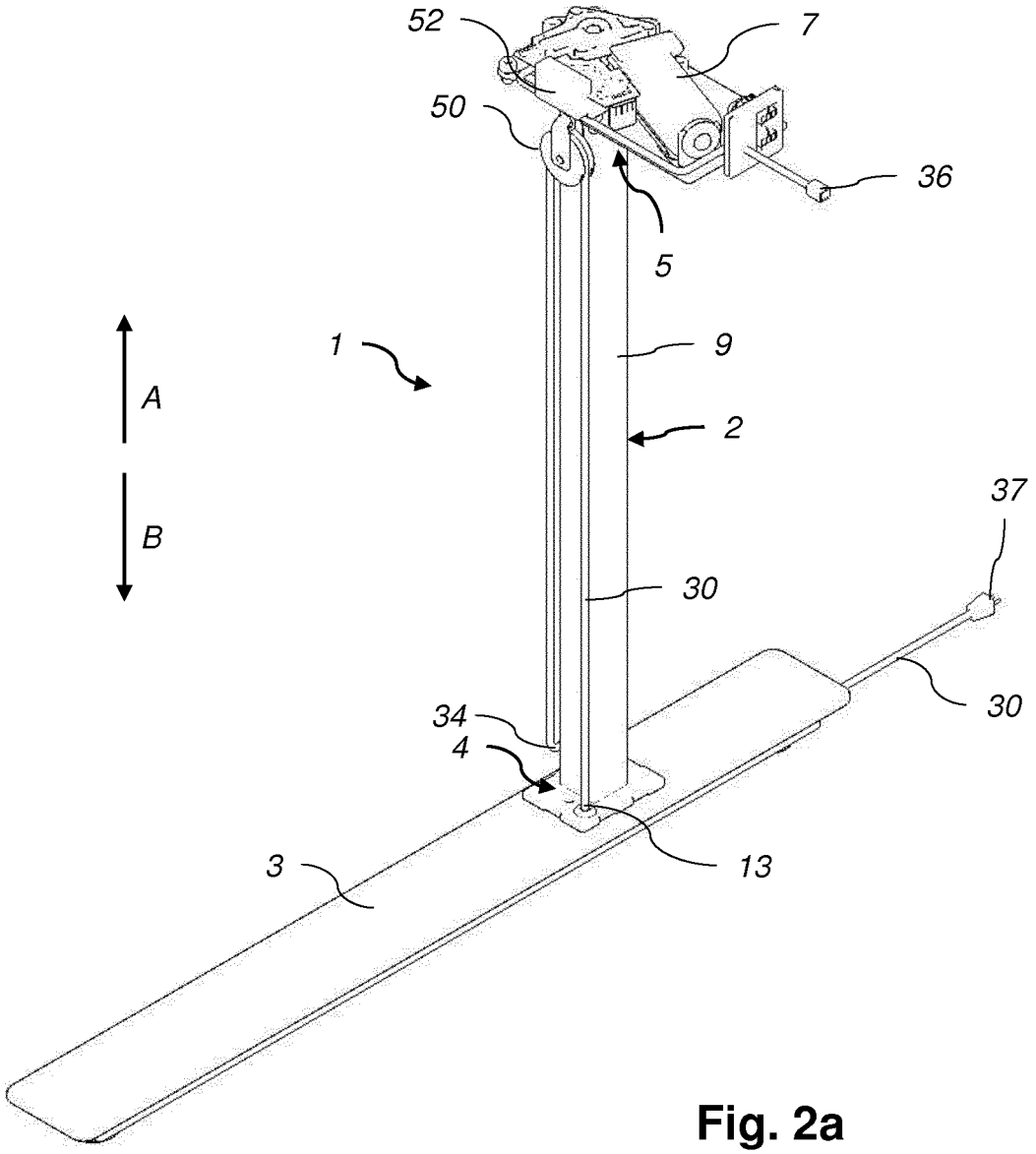
FIGS. 2*a*, 2*b*, 2*c* and 2*d* are perspective view of a telescopic column according to embodiments of the invention.
Figure 2B:
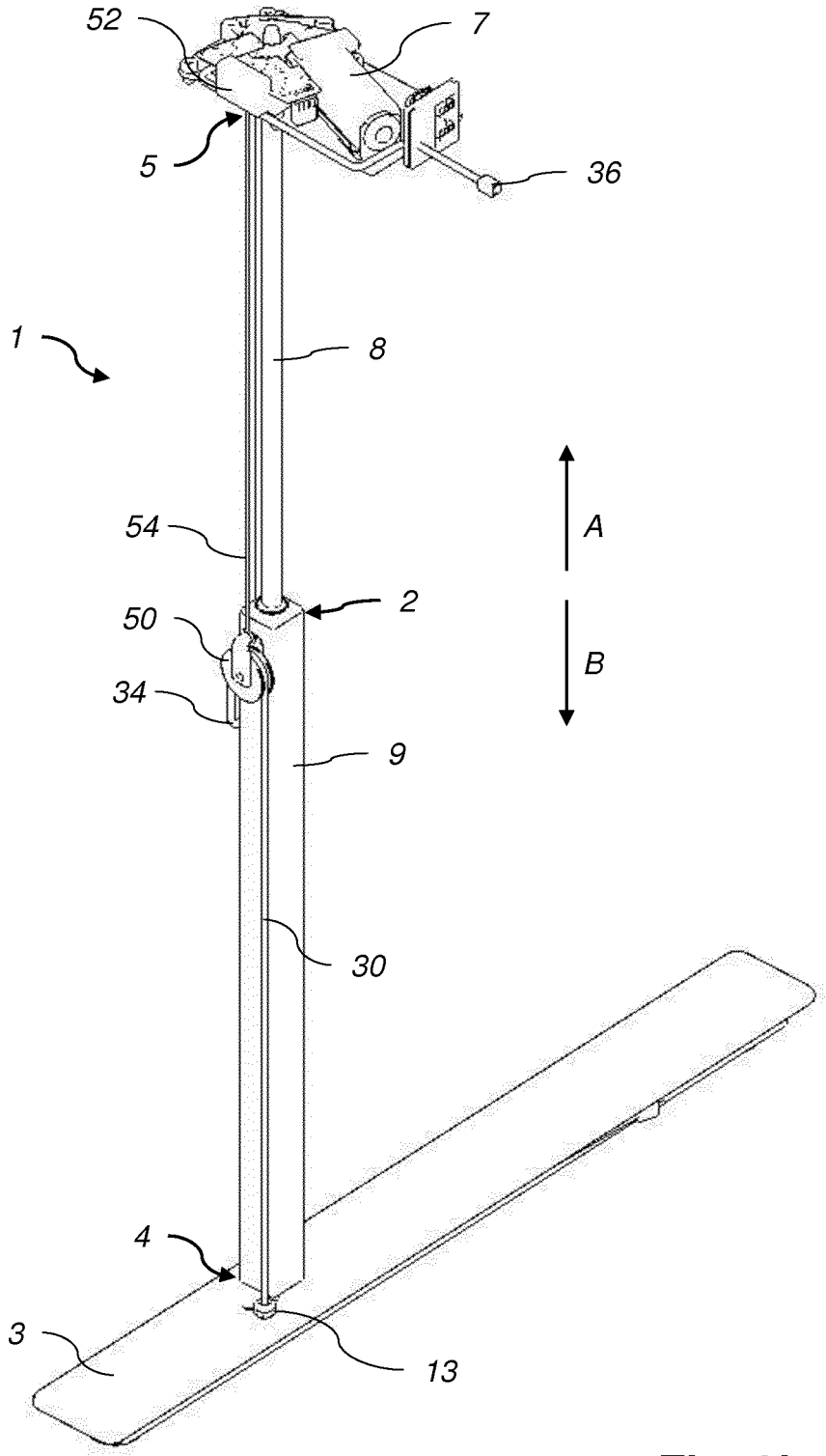

FIGS. 2*a* and 2*b* further illustrate the column 1 in retracted and expanded state, wherein the tubes 10, 20 have been remove to view the parts inside. Inside the column 1 there is arranged a drive mechanism 2 attached to a drive unit 7 in the drive housing 40. The drive mechanism 2 comprises a nut member 9 and a spindle 8, rotatable by means of the drive unit 7.

Figure 3A:
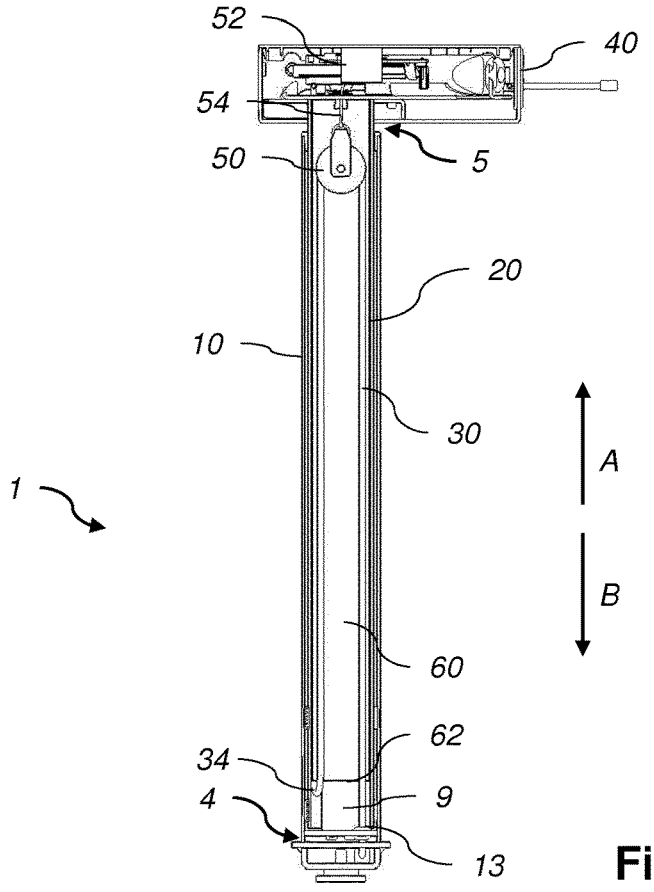
FIGS. 3*a* and 3*b* are cross-sectional views of a telescopic column according to embodiments of the invention.
Figure 3B:
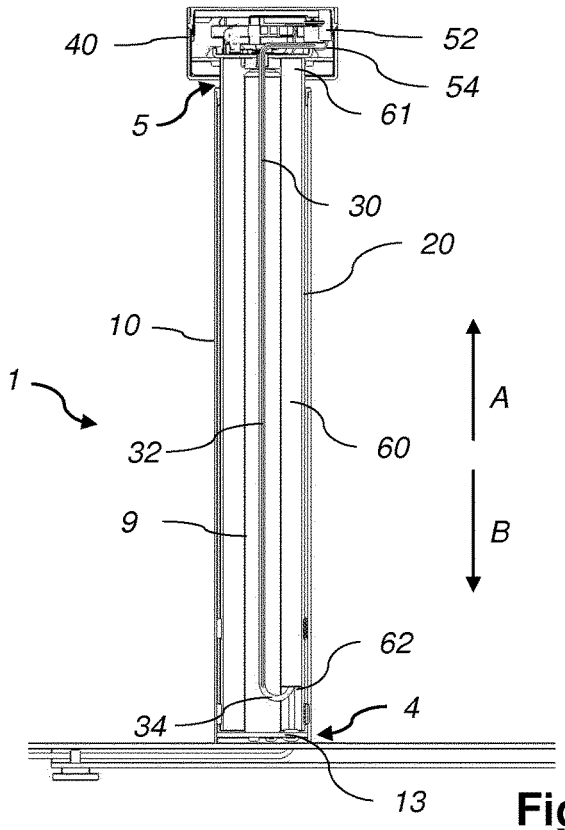

Inside the lower tube 10, the cable 30 extends from an attachment point 13 at the first end 4 of the column 1, towards the second end 5 of the column 1. When the column 1 is in its retracted state, a majority of the upper tube 20 is positioned inside the lower tube 10. The cable 30 thereby extends also inside the upper tube 10 towards the second end 5. Inside the upper tube 20, a cable guiding means is arranged. The cable guiding means is in the illustrated embodiment provided as a pulley 50 suspended in a wire 54. The wire is attached to a tensioning device 52 arranged at the second end 5. As seen in e.g. FIG. 2*a*, the tensioning device 52 is arranged in the drive housing 40. The interior of the column 1, having two or three tubes, is further illustrated in cross-sectional views in FIGS. 3-5. The cable 30 is arranged on the pulley 50 to be suspended thereon such that the cable 30 makes a U-turn around the pulley 50. The cable 30 extends further back towards the first end 4 until it reaches a bottom end 22 of the upper tube 20. At the bottom end 22 the cable has a turning point 34 at which it turns to extend further again towards the second end 5. When the cable 30 reaches the second end 5 it exits the upper tube 20 at a top end 21 of the upper tube 20. The cable 30 further extends into the drive housing 40. In the illustrated embodiments the cable 30 then proceeds out of the drive housing 40 to a second end 36. The second end 36 may be configured to be connected to a power unit (not shown) for the furniture which the column 1 is a part of. From the turning point 34 to the second end 5 of the column 1 an upper portion 32 of the cable 30 is stretched and fixed relative to the upper tube 20 and the drive housing 40.

The tensioning device 52 is arranged in the drive housing 40. The tensioning device 52 may alternatively be arranged outside the drive housing 40 at the second end 5. The wire 54 extends from the tensioning device 52 into the upper tube 20 to suspend the pulley 50. The length of the wire depends on the expansion of the column 1, i.e. the relative telescopic positions of the lower and upper tubes 10, 20, and in the three tube embodiment also the middle tube 90. In the most retracted position of the column 1, the pulley 50 is located close to the second end 5 of the column, i.e. at the upper end 21 of the upper tube 20. When the column 1 is in its most expanded position, the wire 54 is extended such that the pulley 50 is located closer to the second end 22 of the upper tube 20. The pulley 50 is pulled towards the second end 22 of the upper tube 20 by the cable 30 when the column 1 expands from a retracted position towards the most expanded position. In the illustrated embodiments, a wire protection 56 is provided at the point the wire 54 exits the drive housing 40 and enters the upper tube 20. The wire 54 extends through a hole and the wire protection 56 is configured to protect the wire 54 as it moves back and forth through the hole.

The tensioning device 52 is spring-loaded to apply a force on the pulley, via the wire 54, in a direction A towards the tensioning device, i.e. towards the second end 5 of the column 1. The tensioning device 52 comprises a spring, preferably a clock spring, which applies the force pulling the pulley 50. When the column 1 expands, the cable 30 provides a force on the pulley 50 towards the first end 4 of the column, in direction B, that exceeds the force in direction A that the tensioning device 40 applies to the pulley 50. The wire 54 thereby extends such that the pulley 50 moves inside the upper tube 20 in direction B relative to the upper tube 20. When the column 1 retracts, the force of the spring-loaded tensioning device 52 retracts the wire 54 such that the pulley 50 moves inside the upper tube 20 in direction A. The cable 30 is thereby, along its extension from the first end 4 towards the second end 5 via the pulley 50, always in a stretched state, which prevents damage to the cable 30 due to interference with other parts of the column, such as the spindle 8 of the drive mechanism 2.

Figure 2C:
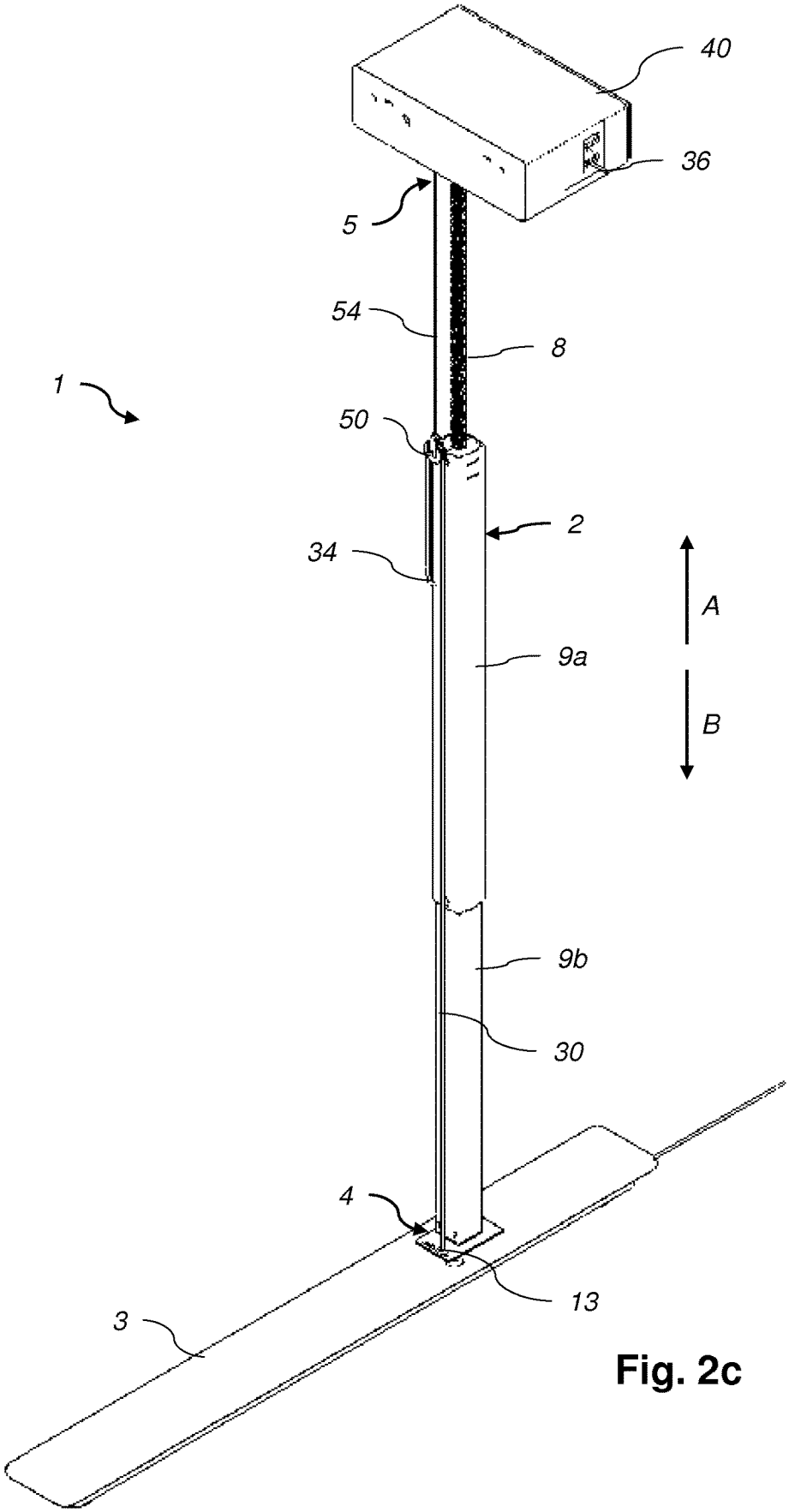
Figure 2D:
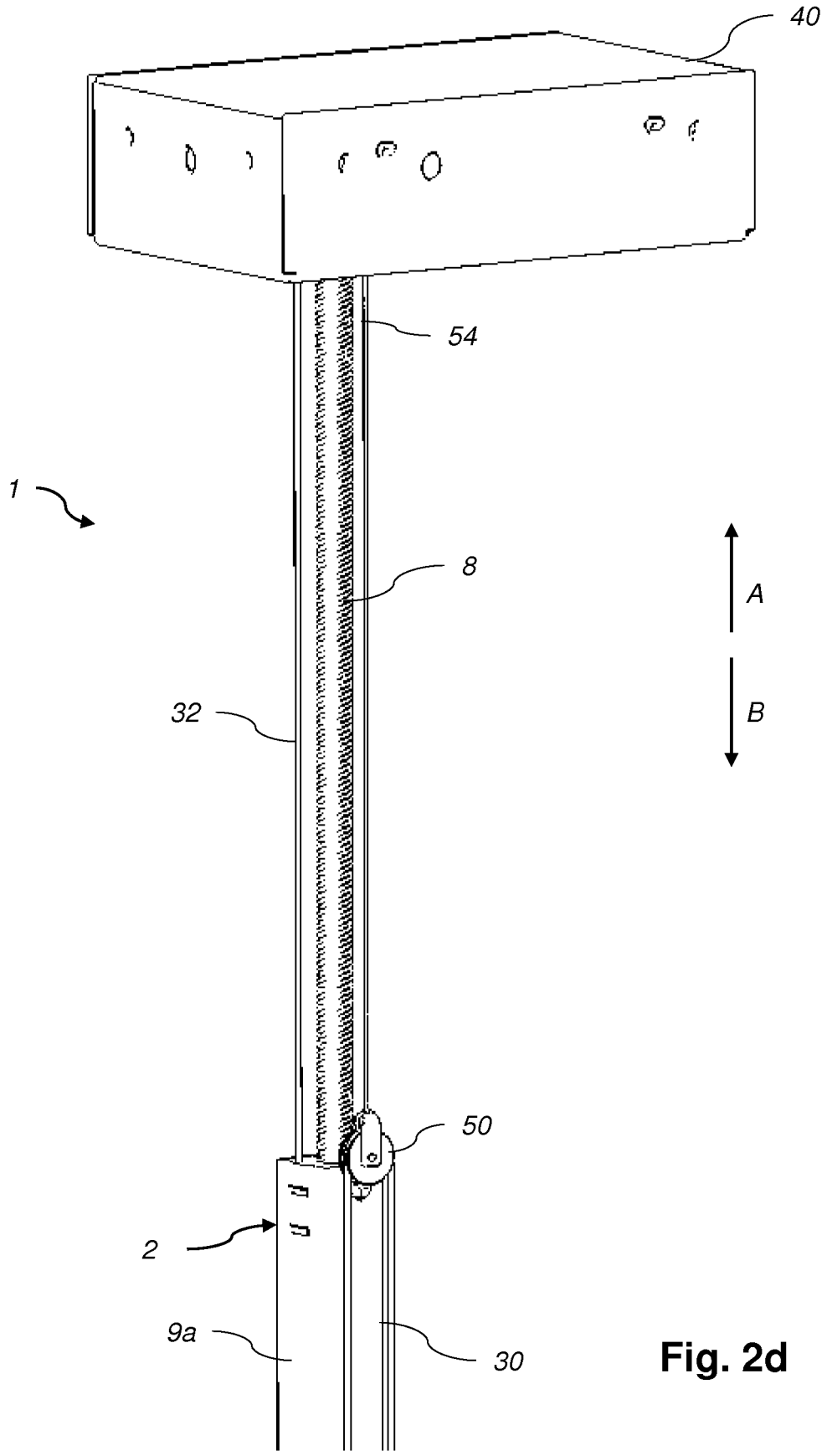

FIGS. 2*c* and 2*d* further illustrate the interior of three tube embodiment of the telescopic column 1. Besides the above described features of the two tube embodiment, the nut member 9 of the drive mechanism 2 in the three tube column comprises a first nut member 9*a* and a second nut member 9*b*. The first nut member 9*a* is configured to be attached to the middle tube 90, and provide the telescopic movement thereof. The second nut member 9*b* is configured to be attached to the lower tube 10, and provide the telescopic movement thereof. The second nut member 9*b* is attached to the foot 3 of the column 1. The two nut members 9*a*, 9*b* together with the spindle 8 are configured to provide the telescopic expansion and retraction of the column when the spindle 8 is rotated by the drive unit 7. The first nut member 9*a* may internally comprise a second spindle (not shown) configured to interact with the second nut member 9*b*.

In one embodiment, as illustrated in FIGS. 3-7, the column 1 further comprises a sheath 60 arranged inside the upper tube 20. The sheath 60 is separated from the drive mechanism 2. The sheath 60 is further provided as a tube with open ends 61, 62. The pulley 50 is arranged inside the sheath 60 and arranged to move inside the sheath 60 during expansion and retraction of the column 1. The cable 30 extending from the first end 4 towards the pulley 50 enters into the sheath 60 at the end 62 of the sheath being adjacent the second end 22 of the upper tube 20. After having extended via the pulley 50, the cable 30 exits the sheath 60 at the same end 62. After turning at the turning point 34, the cable 30 extends in its upper portion 32 to the second end 5 and the drive housing 40. By moving inside the sheath 60, the pulley 50, being suspended in the wire 54, is prevented from interfering with the drive mechanism 2 and especially the spindle 8. The wire 54 extends from the tensioning device 52 in the drive housing 40 into the sheath 60 at its end 61 in the upper tube 20.

At the turning point 34, the cable 30 could be attached or fixed to the end 62 of the sheath 60 in order to have the upper portion 32 of the cable 30 fixedly stretched.

The sheath 60 is fixed to the upper tube 20 or to the drive housing 40, or both.

Figure 4:
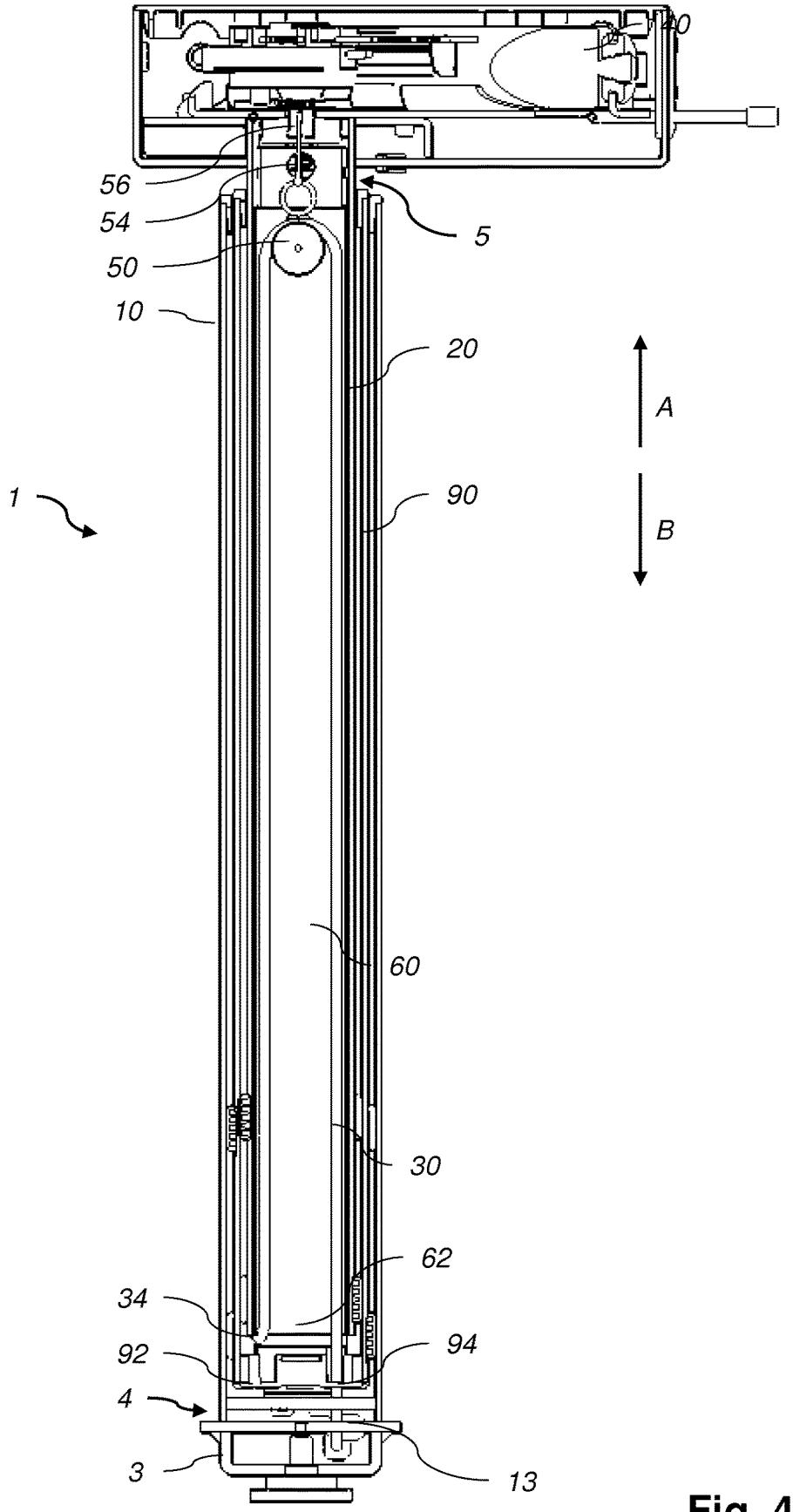
FIG. 4 is a cross-sectional view of a telescopic column according to an embodiment of the invention.
Figure 5A:
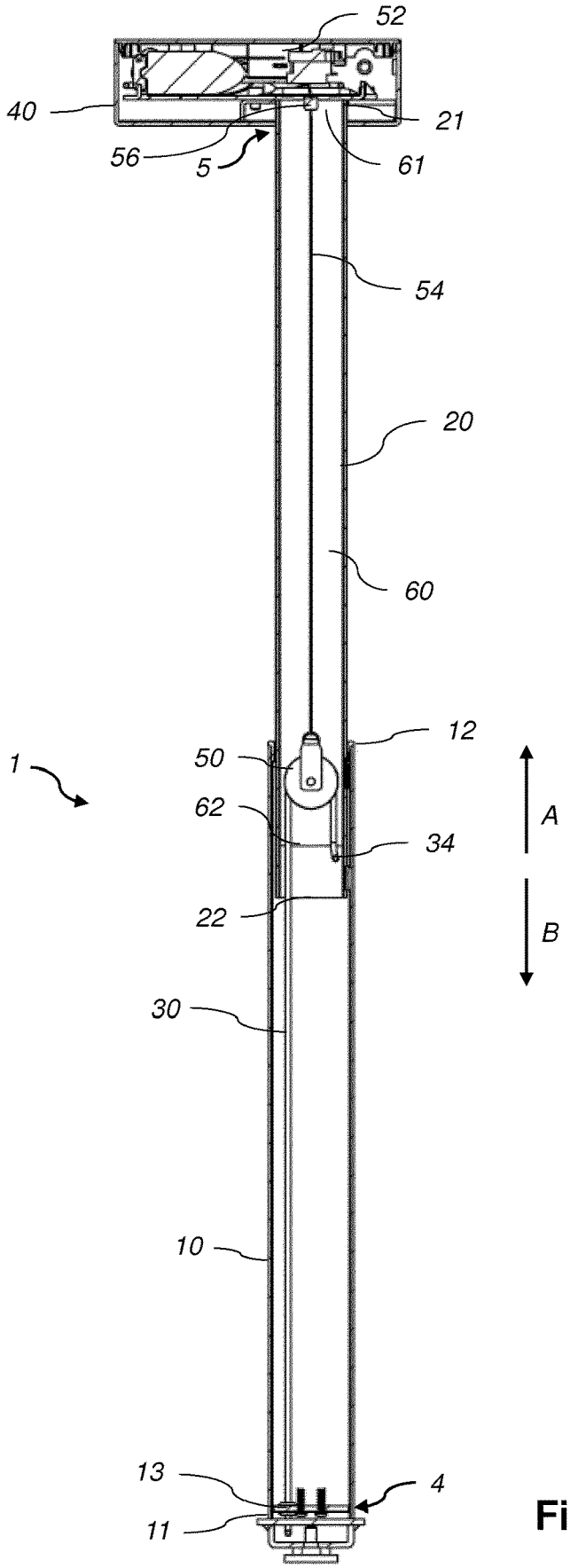
FIGS. 5*a* and 5*b* are cross-sectional views of a telescopic column according to embodiments of the invention.
Figure 5B:
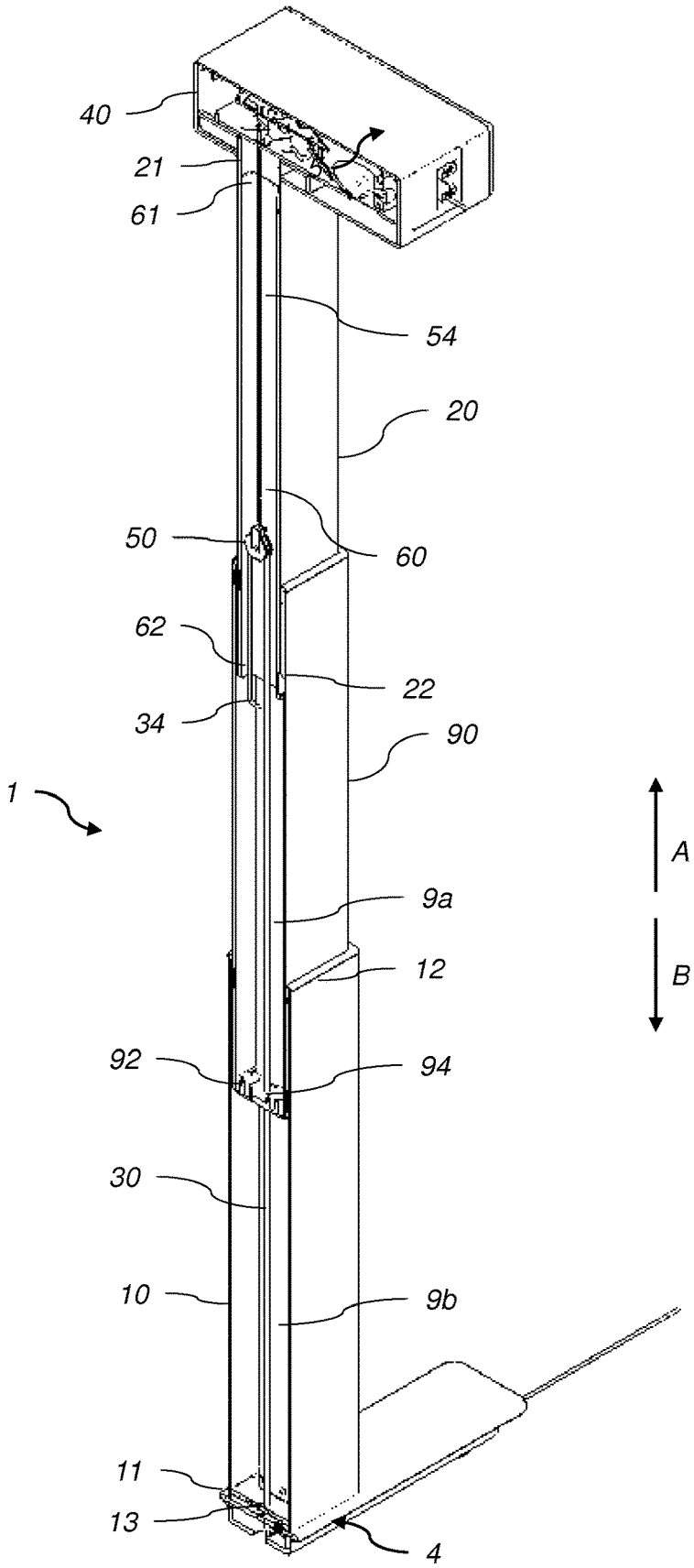
Figure 6:
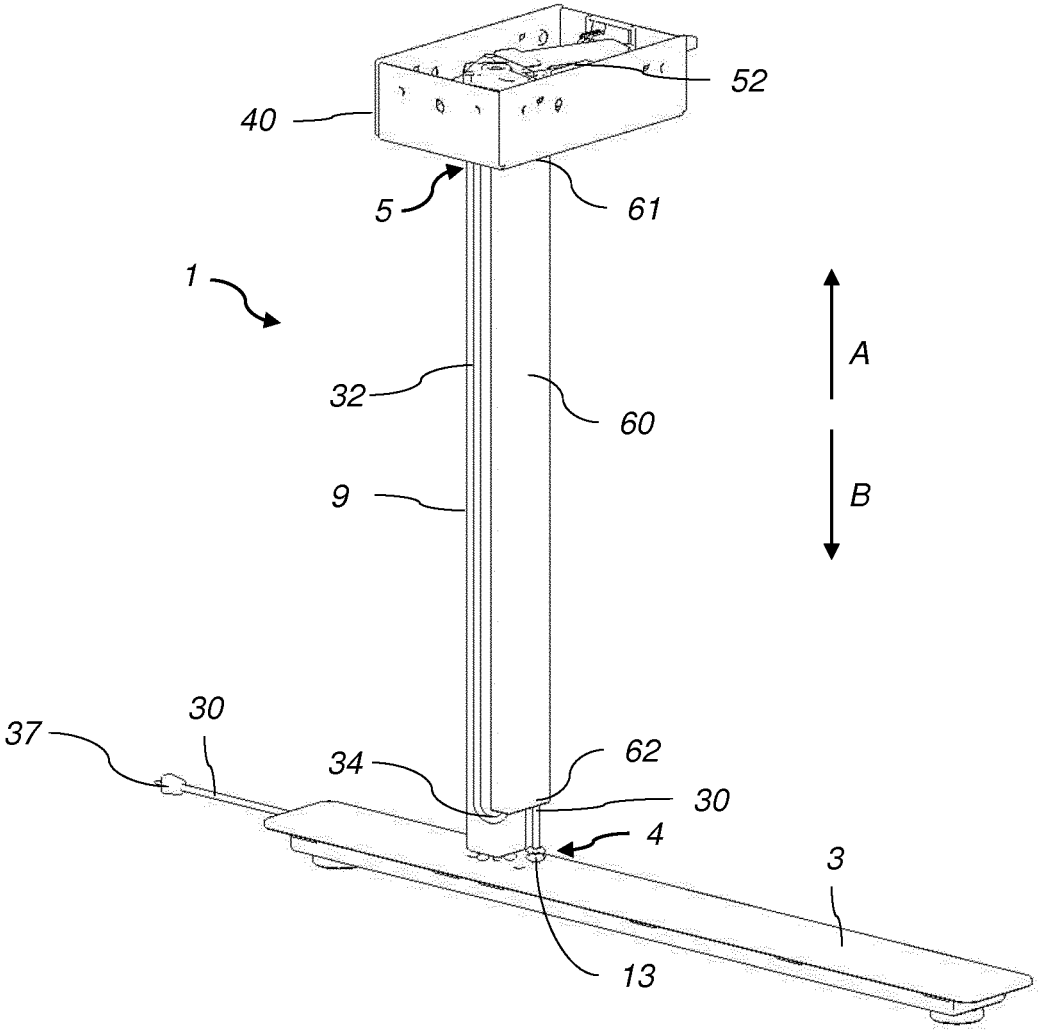
FIG. 6 is a perspective view of a telescopic column according to an embodiment of the invention.
Figure 7A:
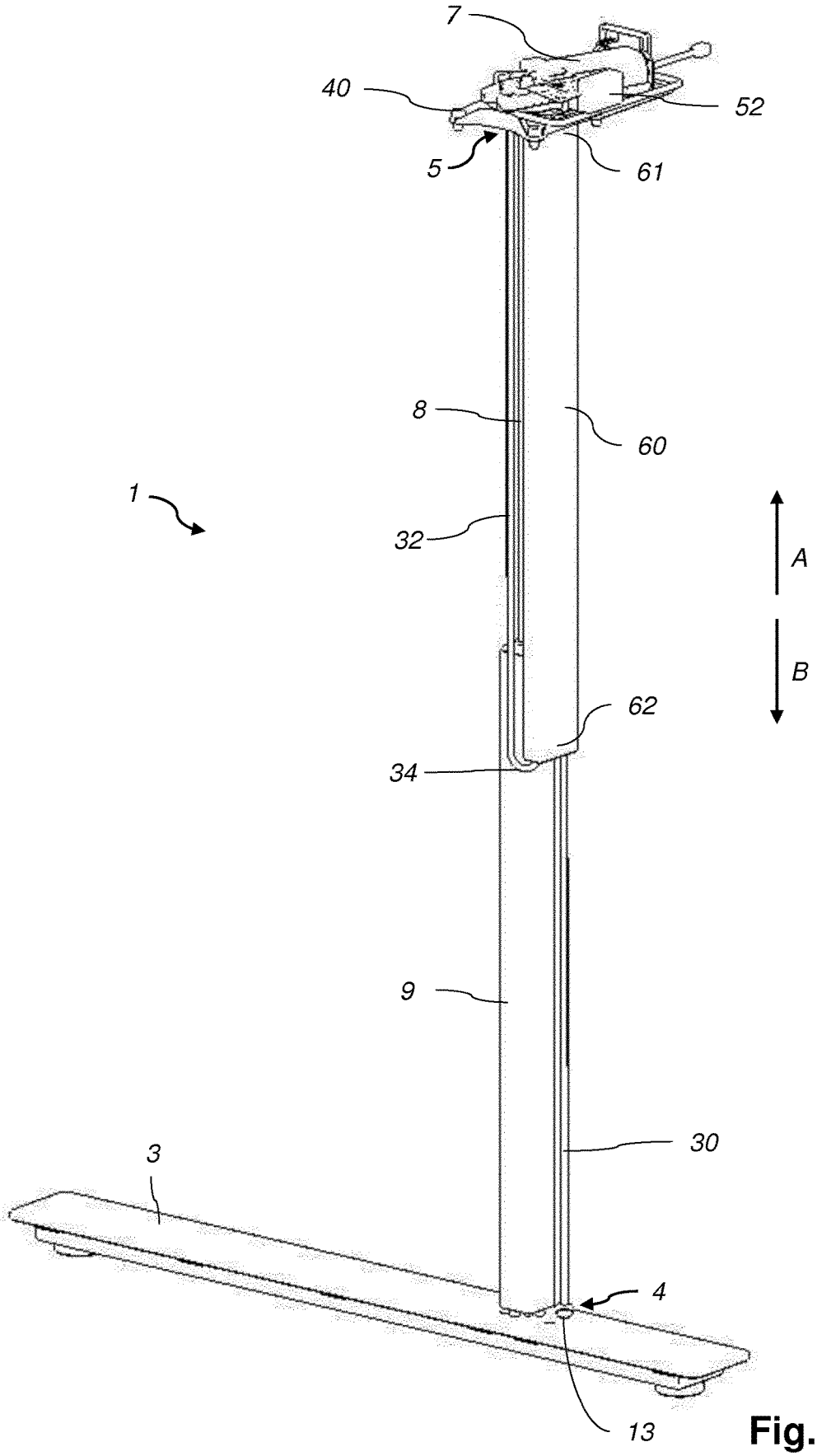
FIGS. 7*a* and 7*b* are perspective views of a telescopic column according to embodiments of the invention.
Figure 7B:
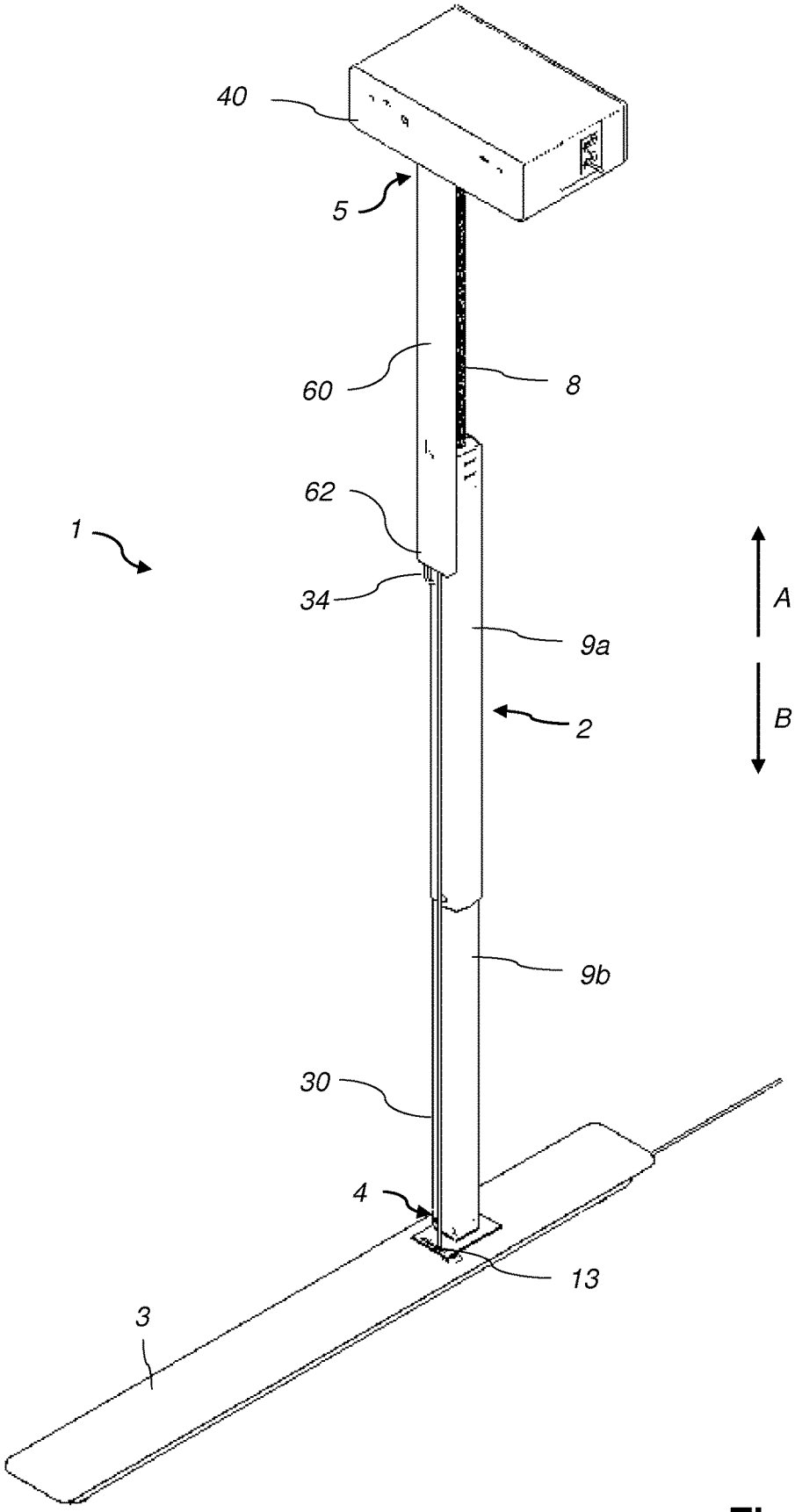

FIGS. 4, 5*b* and 7*b* illustrate the three tube embodiment of the telescopic column 1 in cross section. Besides the above described for the two tube embodiment, the three tube embodiment of the column 1 comprises, as seen in FIGS. 4 and 5*b*, a bearing 92, such as a sliding bearing, at a lower end of the middle tube 90. The bearing 92 provides a stable positioning and movement of the middle tube 90 relative to the lower tube 10. At the fully retracted position of the column 1, as seen in FIG. 4, the bearing 92 is located at the first end 4 of the column 1. The bearing 92 is provided with a bushing 94 for the cable 30. The cable 30 thereby extends through the bushing 94 on its way towards the second end 5 of the column 1.

Figure 8:
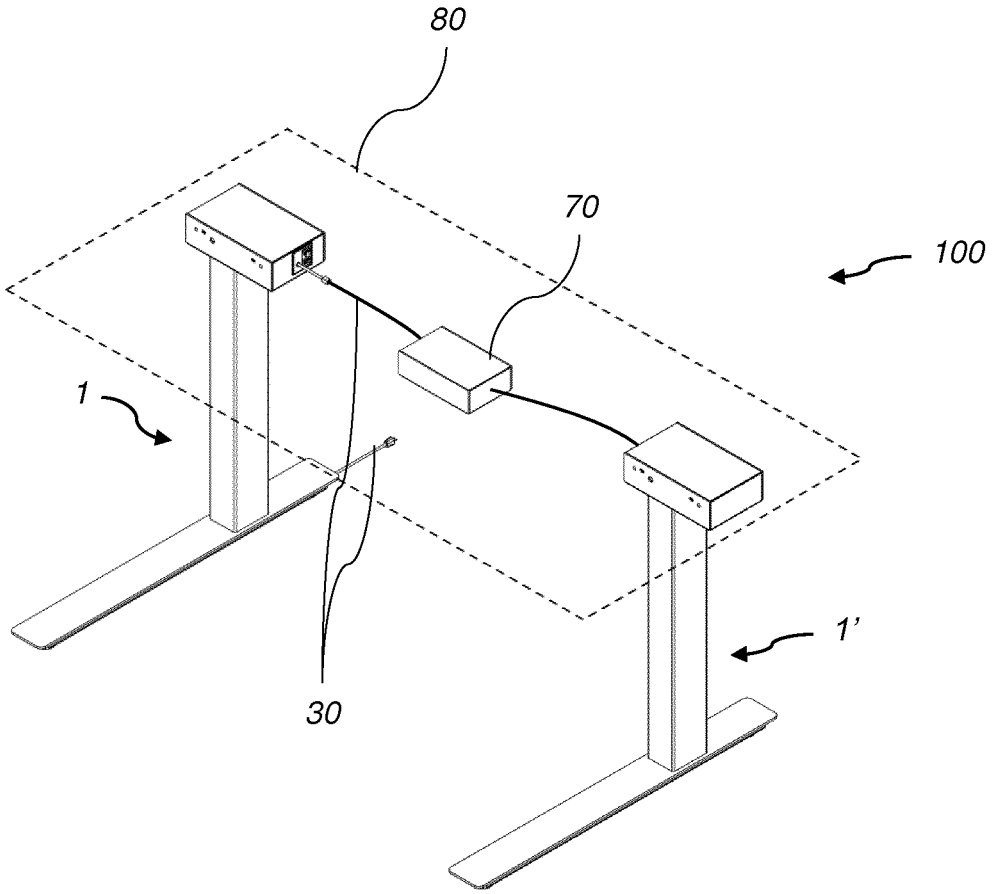
FIG. 8 is a perspective view of an adjustable furniture according to an embodiment of the invention.

FIG. 8 illustrates an adjustable furniture as a height-adjustable table 100 comprising a table top 80 and two telescopic columns 1, 1'. One of the telescopic columns 1 is provided with an internally extending cable 30 as presented above. The cable 30 extends from the telescopic column 1 to a control unit 70 which powers and controls the operation of the two columns 1, 1'.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A telescopic column for adjustable furniture comprising a lower part having a first end constituting a first end of the telescopic column, an upper part telescopically moveable relative to the lower part and having a first end constituting a second end of the telescopic column opposite said first end of the telescopic column, a drive mechanism configured to provide telescopic movement between the lower part and the upper part, wherein the drive mechanism comprises a spindle, a cable extending inside the telescopic column, and a cable guiding means coupled to a tensioning device arranged at the second end of the telescopic column, wherein the tensioning device is configured to control the position of the cable guiding means in the telescopic column such that the cable guiding means is configured to be moved up or down inside the upper part by means of the tensioning device when the telescopic column is retracted or expanded, wherein the telescopic column further comprises a sheath through which the cable guiding means is moveable and wherein the sheath extends in parallel with the spindle but is separated therefrom, and wherein the cable enters the telescopic column at the first end of the column and extends through the column via the cable guiding means and inside the sheath and exits the column at the second end of the column.

2. The telescopic column according to claim 1, wherein the cable guiding means comprises a pulley.

3. The telescopic column according to claim 1, wherein the cable guiding means is suspended by means of a wire to the tensioning device.

4. The telescopic column according to claim 1, wherein the tensioning device is configured to provide a force on the cable guiding means directed towards the second end of the telescopic column.

5. The telescopic column according to claim 1, wherein the tensioning device comprises a spring.

6. The telescopic column according to claim 1, wherein the cable extends from said first end of the telescopic column to the cable guiding means and further to a second end of the upper part, said second end facing the lower part.

7. The telescopic column according to claim 1, wherein the cable is axially fixed at one end relative to the second end of the telescopic column and at another end relative to first end of the telescopic column.

8. The telescopic column according to claim 1, wherein the sheath comprises an insulated tube.

9. The telescopic column according to claim 1, wherein the cable extends from the first end of the telescopic column into the sheath to the cable guiding means, further through the sheath towards a second end of the upper part, which second end facing the lower part, and out of the sheath to further extend towards the second end of the telescopic column.

10. The telescopic column according to claim 1, wherein the tensioning device is arranged outside of either of the upper part and the lower part.

11. The telescopic column according to claim 10, wherein the tensioning device is coupled to the cable guiding means via a wire.

12. An adjustable furniture comprising a telescopic column according to claim 1.

* * * * *